US006169258B1

(12) United States Patent
Roney et al.

(10) Patent No.: US 6,169,258 B1
(45) Date of Patent: Jan. 2, 2001

(54) THREE POSITION CONTROL SWITCH ASSEMBLY

(75) Inventors: Jeffrey T. Roney, Stanford; Bradley T. Baker, Danville, both of KY (US)

(73) Assignee: Matsushita Electric Corporation of America, Danville, KY (US)

( * ) Notice: Under 35 U.S.C. 154(b), the term of this patent shall be extended for 0 days.

(21) Appl. No.: 09/125,969

(22) PCT Filed: Dec. 31, 1996

(86) PCT No.: PCT/US96/20897

§ 371 Date: Aug. 27, 1998

§ 102(e) Date: Aug. 27, 1998

(87) PCT Pub. No.: WO98/29022

PCT Pub. Date: Jul. 9, 1998

(51) Int. Cl.[7] ..... H01H 9/20
(52) U.S. Cl. ..... 200/332.2; 200/321; 200/522
(58) Field of Search ..... 200/332.2, 321, 200/322, 522

(56) References Cited

U.S. PATENT DOCUMENTS

| | | | | |
|---|---|---|---|---|
| 3,667,084 | | 6/1972 | Valbona et al. . | |
| 3,766,347 | | 10/1973 | Brooks et al. . | |
| 3,881,081 | * | 4/1975 | Schilling et al. | 200/157 |
| 4,280,026 | * | 7/1981 | Alessio | 200/321 X |
| 4,421,964 | * | 12/1983 | Buchtel | 200/332.2 |
| 4,535,501 | | 8/1985 | Hollowell et al. . | |
| 5,099,544 | | 3/1992 | Yamamoto . | |
| 5,638,945 | * | 6/1997 | Fukinuki et al. | 200/321 X |

* cited by examiner

*Primary Examiner*—Renee Luebke
(74) *Attorney, Agent, or Firm*—King & Schickli

(57) ABSTRACT

A vacuum cleaner includes a housing having a nozzle assembly and a handle. An agitator brush is mounted for relative rotation on the nozzle assembly. A motor and fan subassembly are mounted in the housing. A three position control switch is carried on the handle. The control switch is selectively positionable in an off position, a continuously on position and an automatic on/off touch control position whereby the motor is activated by squeezing the control switch assembly and deactivated by releasing the control switch assembly.

5 Claims, 3 Drawing Sheets

54
52
56
18
58
42
84
62
46
11
58
C
B
59
60

54
56
52
58
74
82
76
84
48
72
66
70
62
50
42
68
64
46

54
56
58
18
80
76
62
68
64
46
42
50
78
70
74
48
A
D
52

THREE POSITION CONTROL SWITCH ASSEMBLY

TECHNICAL FIELD

The present invention relates generally to the vacuum cleaner art and, more particularly, to a unique three position control switch assembly for a vacuum cleaner providing greater versatility and control convenience to the vacuum cleaner operator.

BACKGROUND OF THE INVENTION

Vacuum cleaners have long utilized snap action on/off switches in order to control the operational state of the motor or motors that drive the fan to produce the vacuum suction and drive the agitator brush that beats and scrubs dirt and debris from the nap of the carpet being cleaned. Such control switches have been provided at various locations. For example, many designs incorporate an on/off control switch on the lowermost portion of the housing adjacent the floor. Others incorporate an on/off control switch in the area of the hand grip of the handle. Still others incorporate an on/off control switch at an intermediate position, either along the handle below the hand grip or on the canister body which holds the dust bag.

While an on/off control switch on the housing adjacent the floor may usually be conveniently accessed for manipulation by means of the foot of the operator, it should be appreciated that many operators prefer to manipulate the on/off switch by hand. Thus, a switch mounted in such a low position inconveniently requires such an operator to stoop or squat in order to reach the switch which is a significant annoyance.

It should further be appreciated that an on/off control switch mounted on the lowermost housing portion of the vacuum cleaner is often difficult to reach. Specifically, as the vacuum cleaner is manipulated by the operator, the handle pivots relative to the lowermost portion of the housing covering the nozzle assembly. At certain pivot angles, an operator holding the hand grip cannot reach an on/off control switch on the nozzle housing with his/her foot or other means. Further, the nozzle body in some circumstances may be underneath a chair, table or other furniture which blocks the line of sight of the operator to the on/off control switch thereby preventing, for example, deactivation of the vacuum cleaner at a time when the fringe of a throw rug or other object is inadvertently drawn into the agitator brush. Of course, at such times rapid degenerization of the vacuum cleaner motor is desired and any delay may result in damage to the throw rug or even the vacuum cleaner.

Of course, it should also be appreciated that at certain pivot angles of the handle a switch along the intermediate portion of the handle or canister body may also be difficult to see and/or access readily in this type of emergency. Thus, at first it appears that the mounting of the control switch on the operator hand grip is the solution. Upon further consideration, however, it should be appreciated that such a hand grip mounted control switch is often inadvertently triggered as the operator applies the necessary force to manipulate the vacuum cleaner along the floor. This can be inconvenient and frustrating for the operator. Further, it should be appreciated that such a switch may make the hand grip uncomfortable to the operator as the vacuum cleaner is guided across the floor first pushing and then pulling in a reciprocating forward and backward motion. Accordingly, a need exists for a better solution and the development of a more versatile control switch which meets all the needs of the vacuum cleaner operator.

SUMMARY OF THE INVENTION

Accordingly, it is a primary object of the present invention to provide a vacuum cleaner incorporating a novel three position control switch assembly overcoming the above described limitations and disadvantages of the prior art.

Still another object of the present invention is to provide a control switch assembly for a vacuum cleaner that provides greater versatility and ease of operation.

Still another object of the present invention is to provide a vacuum cleaner control switch assembly providing three distinct operating modes including an off position, a continuously on position and an automatic on/off touch control position whereby the motor of the vacuum cleaner is activated by squeezing the control switch assembly and deactivated by releasing the control switch assembly formed in the hand grip of the vacuum cleaner. Accordingly, sure positive control of the vacuum cleaner is provided at all times in accordance with the desire of the operator.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a vacuum cleaner is provided incorporating a novel three position control switch assembly convenience feature. The vacuum cleaner includes a housing having a nozzle assembly and a handle. An agitator brush is mounted for relative rotation on the nozzle assembly. A motor and fan subassembly are mounted in the housing. Either one or two motors may be provided for driving the fan and producing a vacuum suction and driving the agitator brush which beats and brushes dirt and debris from the nap of the carpet being cleaned.

The vacuum cleaner also includes the novel three position control switch assembly. This control switch assembly is mounted on the handle and includes an off position, a continuously on position and an automatic on/off touch control position. In this latter position, the motor(s) of the motor and fan subassembly is activated by squeezing the control switch assembly, located in the hand grip of the handle, and deactivated by releasing the control switch assembly. Thus, in this position when the hand grip assembly is grasped by the vacuum cleaner operator, the switch is closed and the motor is energized to allow vacuuming. In contrast, immediately upon release of the hand grip, the motor is deenergized. Hence, the vacuum cleaner is essentially made immediately responsive to the operator with the motor(s) being energized with a squeeze of the hand grip and deenergized with the release of pressure on the hand grip.

Preferably, the control switch assembly includes a switch lever and a cooperating switch lever lock for engaging the switch lever. The switch lever is mounted for pivotal movement relative to the hand grip of the handle and the switch lever lock is mounted to provide relative sliding movement along the handle. The control switch assembly further includes a microswitch and a linkage connecting the switch lever to the microswitch. In accordance with yet another aspect of the present invention, the switch lever includes a notch providing two stops and the switch lever lock includes a cooperating camming lug received in that notch. When the control switch assembly is in the off position the camming lever engages the first of those stops. When the control switch assembly is in the continuously on position, the camming lug engages the second of those stops. Cooperating cam faces on the switch lever and switch lever lock function to allow the switch lever lock to displace the switch lever into the off and continuously on positions from the intermediate, automatic on/off control position.

Advantageously, the control switch assembly incorporated into the vacuum cleaner of the present invention provides versatile operation that may be tailored to the needs of the vacuum cleaner operator. For example, in a first position, the switch lever lock functions to lock the switch lever in order to insure that the vacuum cleaner remains in an off position. This is true whether or not the hand grip is grasped and squeezed by the operator. Thus, the vacuum cleaner may be manipulated and moved by means of the hand grip without energizing the vacuum cleaner motor. This allows the operator to quietly guide the vacuum cleaner from place to place by grasping the hand grip even when operation of the vacuum cleaner motor is not desired.

In the on position, the switch lever lock engages the switch lever and maintains the motor in an energized state whether or not the hand grip is grasped by the operator. This is a desired operating condition when, for example, off the floor cleaning is being completed by means of the suction hose and auxiliary attachments.

Finally, in the third position the vacuum cleaner is energized when the operator grips and squeezes the control handle. When the control handle is released, however, the motor is deenergized. This is a preferred operating mode when, for example, vacuuming a child's bedroom where the operator must periodically move shoes, toys or other objects from the path of the vacuum cleaner. Thus, when the operator releases the hand grip to move the object, the motor is deenergized and the agitator brush ceases to rotate so that when the vacuum cleaner is stationary, a spot of the carpet is not subjected to needless wear by the agitator brush. When the operator then again grasps the control handle, the motor is reenergized and vacuuming continues. Advantageously, this "automatic response" is provided without any manipulation of a snap switch. Accordingly, operator convenience is maximized.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
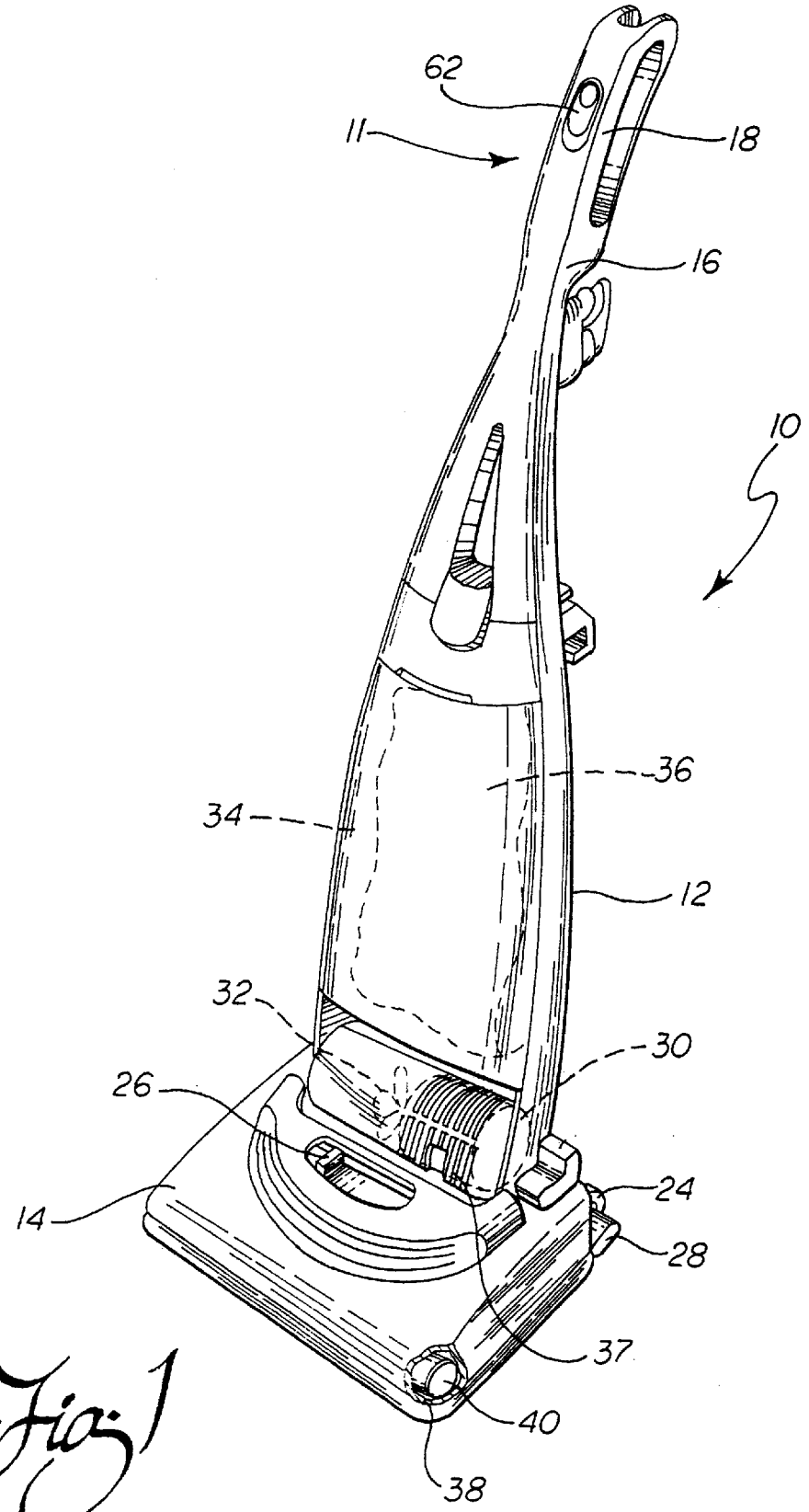
FIG. 1 is a perspective view of the vacuum cleaner of the present invention.

Reference is now made to FIG. 1 showing, in perspective view, an upright vacuum cleaner 10 incorporating a three position control switch assembly 11 constructed in accordance with the teachings of the present invention. The overall basic design of an upright vacuum cleaner 10 is generally well known in the art. Specifically, the upright vacuum cleaner 10 includes a canister assembly 12 pivotally connected to a nozzle assembly 14 by means of a hinge assembly (not shown). A handle 16 is rigidly attached to the top of the canister assembly 12. The handle 16 includes a hand grip 18 which carries the control switch assembly 11 for turning the vacuum cleaner on and off. Of course, electrical power is supplied through a cord (not shown).

At the lower portion of the canister assembly 12, rear wheels 24 are provided to support the weight of the vacuum cleaner 10 and provide a pivot point about which the nozzle assembly 14 pivots when the height of the nozzle assembly is adjusted by manipulation of the height adjustment switch 26. The operation of the height adjustment switch 26 and its cooperating mechanism are described in detail in U.S. Pat. No. 5,467,502 to Johnson et al. Of course, as is known in the art, a foot latch 28 locks the canister assembly 12 in an upright position shown in FIG. 1 in order to allow storage and off the floor cleaning. When the foot latch 28 is released, the canister assembly 12 may be pivoted relative to the nozzle assembly 14 in a manner well known in the art.

The canister assembly 12 also includes a motor 30 that drives a fan 32 which generates a negative pressure or vacuum suction in an internal chamber 34 which also houses a dust bag 36. Nozzle assembly 14 includes, at its front portion, a nozzle 38 that houses a rotating agitator brush 40. The agitator brush 40 is rotatively driven by the motor 30. Specifically, the motor 30 includes a drive shaft that is connected to the agitator brush 40 by means of a belt 44 (not shown) in a manner well known in the art. Specifically, the motor 30, fan 32 and brush 40 cooperate to brush and beat dirt from the nap of a carpet being cleaned and then draw dirt laden air into the chamber 34 and thorough the porous walls of the dust bag 36. The bag 36, of course, serves to trap suspended dirt and particles inside while allowing the air to pass freely through to the exhaust port 37.

Figures 2, 4:
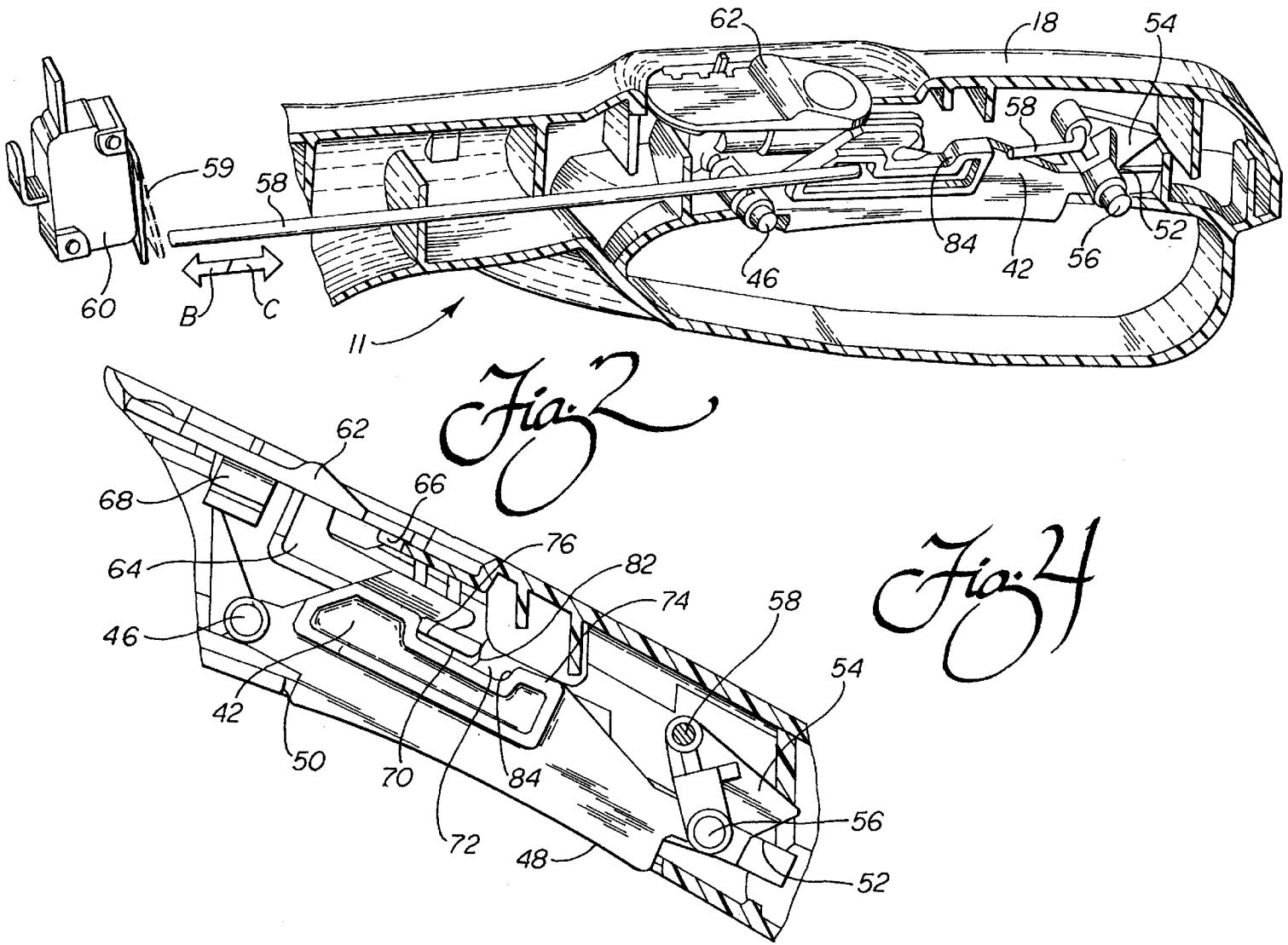
FIG. 2 is a detailed, schematical elevational view showing the control switch assembly in the continuously on position.
FIG. 4 is a detailed view similar to FIGS. 2, 3*a* and 3*b* but showing the control switch assembly in the continuously on position.

The three position control switch assembly 11 will now be described in detail with reference to FIGS. 2, 3*a*, 3*b* and 4. As best shown in FIG. 2, the control switch assembly 11 includes a trigger or switch lever 42 pivotally connected to the housing at the hand grip 18 by means of the pin 46. As shown, the switch lever 42 includes a projecting actuator pad 48 that extends through the opening 50 in the hand grip for relatively easy and comfortable engagement by the operator. Additionally, the distal end of the switch lever 42 includes an integral cam 52 that engages a cam lever 54 pivotally mounted to the housing by means of the pin 56. The cam lever 54 is operatively connected to one end of a push rod linkage 58 that extends through the handle 16 of the vacuum cleaner and has an opposite end that engages a flat spring trip lever 59 for actuating a microswitch 60 mounted remote from the switch assembly 11 in the handle or the canister assembly 12.

Figures 3A, 3B:
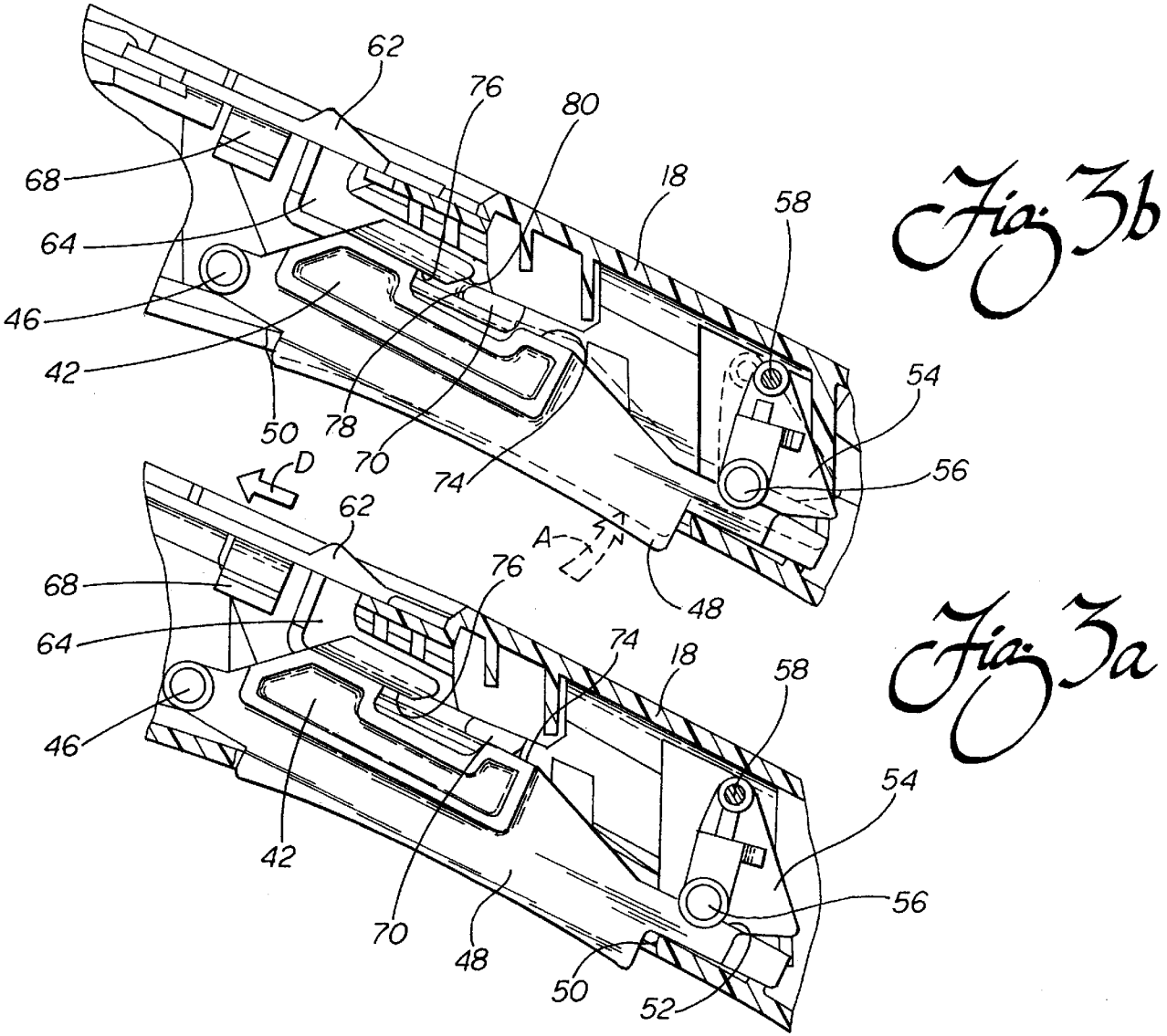
FIG. 3*a* is a view similar to FIG. 2 but showing the control switch assembly in the off position.
FIG. 3*b* is a view similar to FIG. 3*a* with the control switch assembly in the on/off touch control position and with the application of pressure on the hand grip and particularly the switch lever shown by phantom line.

Thus, as should be appreciated from viewing FIG. 3*b*, when the hand grip 18 is squeezed (note action arrow A) and the actuator pad 48 is thereby forced into the hand grip opening 50 as a result of the natural grip of the operator, the cam 52 engages the cam lever 54 causing it to pivot about the pin 56 (see phantom line position). This results in the push rod linkage 58 being extended against (note action arrow B) the lever 59 thereby closing the microswitch 60 and energizing the motor to provide vacuum cleaner operation. In contrast, when the hand grip is released, the switch lever 42 is biased by the flat spring trip lever 59 to the full line position with the actuator pad 48 extending from the hand grip opening 50. In this position, the push rod linkage 58 is retracted (note action arrow C in FIG. 2) under the biasing force of the lever 59 causing the microswitch 60 to open thereby deengerizing the motor.

The actual operation of the switch lever 42 just described is controlled by means of the switch lever lock 62. More specifically, the switch lever lock 62 engages the hand grip 18 so as to provide relative sliding movement along the hand grip. Specifically, the switch lever lock 62 includes an inwardly projecting leg 64 that extends through an elongated opening 66 in the hand grip 18. A backing block 68 insures that the switch lever lock 62 does not pull free from the opening 66.

As further shown in FIGS. 2, 3*a*, 3*b* and 4, the leg 64 carries a camming lug 70. Camming lug 70 projects laterally and is received in a cooperating notch 72 in the switch lever 42. As shown, the notch 72 defines two stops 74, 76. When the switch lever control assembly 11 is in the off position, the switch lever lock 62 is positioned so that the camming lug 70 engages the first stop 74 on the switch lever 42 (see FIG. 3*a*). This engagement prevents the operator from squeezing the actuator pad 48 into the opening 50. Thus, pivotal movement of the switch lever 42 about the pin 46 is also prevented. As a consequence, the control switch assembly 11 is locked in an off position since the push rod linkage 58 cannot be extended to close the lever 59 on the microswitch 60. This is, of course, true even if the hand grip is engaged by the operator of the vacuum cleaner since the engagement of the camming lug 70 with the first stop 74 prevents pivotal movement of the switch lever 42 and therefore, activation of the vacuum cleaner motor.

In the automatic on/off touch control position shown in FIG. 3*b*, the switch lever lock 62 is moved in the direction of action arrow D into an intermediate position wherein the camming lug 70 is positioned in a gap between the first stop 74 and the second stop 76. This gap provides the necessary clearance to allow pivotal movement of the switch lever 42. Accordingly, when the hand grip 18 is disengaged or no squeezing pressure is exerted, the switch lever remains in the full line position shown in FIG. 3*b* and the motor 30 remains deenergized. However, when squeezing pressure is provided on the hand grip 18 (note action arrow A), the actuator pad 48 is depressed into the opening 50. As a result, the switch lever 42 pivots about the pin 46, the cam 52 engages the cam lever 54 which pivots about the pin 56 and the push rod linkage 58 is extended so as to close the lever 59 and thereby close the microswitch 60 (see phantom line showing in FIG. 3*b*). Accordingly, the vacuum cleaner motor 30 is then energized. In this way, the vacuum cleaner provides instantaneous response to operator manipulation in this position. Specifically, squeezing of the hand grip results in the energization of the vacuum cleaner motor and operation of the vacuum cleaner. Releasing of pressure on the hand grip results in the return of the control switch assembly to the position shown in full line in FIG. 3*b* and the deenergization of the motor. As should be appreciated, the free operation of the switch lever 42 between the on/off positions is provided as a result of the notch 72 which provides clearance for the camming lug 70 between the first and second stops 74, 76.

When desired, the control switch assembly 11 may even be placed in a continuously on position shown in FIG. 4. Specifically, in this position, the switch lever lock 62 is moved in the direction of action arrow D along the hand grip 18 so as to slide the camming lug 70 into engagement with the second stop 76. The cooperating camming surfaces 78 and 80 on the respective camming lug 70 and switch lever 42 allows this movement and function to force the switch lever 42 to pivot about the pin 46 into the position as shown. This functions to also pivot the cam lever 54 and extend the push rod linkage 58 so as to close the lever 59 and the microswitch 60 thereby energizing the motor 30 of the vacuum cleaner 10. In this position, the engagement of the camming lug 70 with the second stop 76 functions to maintain the vacuum cleaner continuously on until vacuum cleaner operation is interrupted by some other means such as when the electrical cord is unplugged or the control switch assembly 11 is moved to another position. Of course, it should be appreciated that when the control switch assembly 11 is returned to the off position, the cooperating camming surfaces 82 and 84 on the respective camming lug 70 and switch lever 42 function to allow the desired movement and force the switch lever 42 back into the position shown in FIG. 3*a* with the camming lug 70 engaging the first stop 74.

In summary, numerous benefits result from employing the concepts of the present invention. Advantageously, the three position control switch assembly 11 allows the operating characteristics of the vacuum cleaner to be tuned to the desires of the operator. More particularly, the control switch assembly 11 may be placed in a continuously off or a continuously on position in accordance with standard snap action type switches prevalent in the prior art. As an added alternative and performance feature, the control switch assembly 11 also provides an automatic on/off touch control position. In this position when the operator squeezes the hand grip and particularly, the actuator pad 48, the vacuum cleaner motor 30 is energized and vacuum cleaner operation is provided. When the operator releases the pressure on the hand grip or releases the hand grip all together, the vacuum cleaner motor is deenergized and vacuum cleaner operation ceases.

In many instances, this is a more desirable operating scheme since automatic operation is effectively provided without manipulation of a snap action switch. In fact, this is a desirable feature for both commercial and residential applications as the operator of the vacuum cleaner often has to move objects to vacuum and it is undesirable to leave the agitator brush in engagement with the carpet nap when the vacuum cleaner is maintained in a stationary position for any length of time. This causes excessive and undesired wear on the carpet nap. This problem is easily avoided with the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the present three position switch finds equal utility when used on other devices such as, for example, extractors. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A three position control switch assembly for controlling operation of an electric motor, comprising:

a switch lever and a switch lever lock for engaging said switch lever, said control switch assembly having an off position, a continuously on position and an automatic on/off touch control position whereby said motor is activated by squeezing said control switch assembly and deactivated by releasing said control switch assembly, said control switch assembly being further characterized by a cam lever that cooperatively engages the switch lever, a microswitch including a means for biasing said switch lever, and a push rod linkage that is connected to the cam lever and selectively engages the microswitch.

2. The three position control switch assembly set forth in claim 1, wherein said switch lever includes a notch including two stops and said switch lever lock includes a cooperating camming lug received in said notch.

3. The three position control switch assembly set forth in claim 2, wherein said camming lug engages a first of said stops when said control switch assembly is in said off position and said camming lug engages a second of said stops when said control switch assembly is in said continuously on position.

4. The three position control switch assembly set forth in claim 3, wherein said switch lever and switch lever lock include cooperating cam faces whereby said switch lever lock functions to displace said switch lever into said off and continuously on positions from said automatic on/off touch control position.

5. The three position control switch assembly set forth in claim 4, wherein said switch lever is mounted for pivotal movement and said switch lever lock is mounted for relative sliding movement.

* * * * *